United States Patent [19]

Reisner

[11] Patent Number: 4,690,407

[45] Date of Patent: Sep. 1, 1987

[54] WEIGHTED GOLF GRIP

[75] Inventor: Robert J. Reisner, Chicago, Ill.

[73] Assignee: Para-Tech Industries, Inc., Chicago, Ill.

[21] Appl. No.: 809,039

[22] Filed: Dec. 16, 1985

Related U.S. Application Data

[63] Continuation-in-part of Ser. No. 774,566, Sep. 10, 1985, abandoned.

[51] Int. Cl.[4] ..... A63B 53/14

[52] U.S. Cl. ..... 273/81 A; 273/80 A

[58] Field of Search ..... 273/81 A, 75, 72 R, 273/72 A, 73 J, 80 A, 77 R, 77 A

[56] References Cited

U.S. PATENT DOCUMENTS

| | | | |
|---|---|---|---|
| 1,096,264 | 5/1914 | Palmer | 273/73 J |
| 1,210,182 | 12/1916 | Lynch | 273/81 A |
| 1,658,447 | 2/1928 | Lantz | 273/81 A |
| 1,696,162 | 12/1928 | Victor | 273/81 A |
| 3,075,768 | 1/1963 | Karns | 273/81 A |
| 4,461,479 | 7/1984 | Mitchell | 273/81 A |

FOREIGN PATENT DOCUMENTS

| | | | |
|---|---|---|---|
| 11118 | 8/1901 | United Kingdom | 273/81 A |

*Primary Examiner*—George J. Marlo

*Attorney, Agent, or Firm*—Welsh & Katz, Ltd.

[57] ABSTRACT

A golf club is described, the golf club having a grip with a weighted element integrally attached to the distal end. The weighted element is fixedly secured within the grip and is shaped in the form of an inverted cup, with flanges described from a central spherical portion. The grip itself is of a resilient material and completely encloses the weighted element, including both sides of the flanges. When the grip is secured on the shaft of a golf club, this completely symmetrical weighted grip provides a leverage and balance that permits greater control and tempo in a golfer's swing.

6 Claims, 5 Drawing Figures

WEIGHTED GOLF GRIP

This application is a continuation-in-part of application Ser. No. 774,566, filed Sept. 10, 1985 now abandoned.

This invention relates to improvements in golf clubs and more particularly relates to the weight distribution of a golf club about its fulcrum point.

BACKGROUND OF THE INVENTION

In the past efforts have been made to improve the swings of clubs in the hands of amateur golfers, always searching for better control of the club, for greater distance, and a straighter ball flight. In general, such efforts have been directed principally to the addition of weight to the club head for the redistribution of balance of the club as a whole. Other efforts placed increased weight at various points within the club shaft, some even decreasing the head weight itself, a completely opposite approach.

The present application is based upon the discovery that relocating the fulcrum point of a golf club between the shaft end and the club head moving it towards the grip will materially improve the control and feel of the golf club and dramatically increase the distance and control of the ball's flight.

The present invention provides a novel and improved form of golf club by redistributing the weight of the club, by weighting the club behind the hands and in the grip itself, so that the club itself will tend to bring the hands into considerably better control both during the back swing and the consequent follow through.

In a preferred embodiment of the invention, the golf club is provided with added weight integrally molded into a portion of the hand grip of the club in contrast to devices of the prior art, which have fitted golf clubs with external removable, weighted attachments behind the grip. Other prior art devices have plugged the center of the hollow club shafts with weights, such as steel shot, encasing them in a soft plastic so that they become fixedly mounted within the shaft to prevent movement and noise that might distract a golfer.

SUMMARY OF THE INVENTION

The subject invention comprises a weight located on the end of the shaft of golf club, integrally molded into the hand grip portion thereby presenting no significant visual difference when compared with a regulation club and grip. The weight resembles an inverted cup, having a generally round central weighted portion located entirely behind the shaft and central grip area of the club. The weight assembly may be a one piece unit or may comprise two or more longitudinal portions which mate in a spaced relationship with each other. In each embodiment, the weight assembly has depending flanges which completely envelope the golf club shaft end. Separating the shaft surface from the flange surface, and in tight fitting contact with both shaft and flanges is a resilient material, such as rubber or synthetic plastic, for cushioning impact, maintaining the immobility of the weight assembly, and deadening noise. If the weight assembly is formed of more than one piece, the resilient material also separates each such piece. The grip itself completely surrounds the weight and retains it securely on the shaft. By placing the weight at the end of the shaft and securing it immovably in place with the depending flanges and the cushioning material, a smoother, stronger stroke is experienced when hitting a golf ball, thereby giving a golfer longer, truer shots. The flanges serve not only to securely hold the weight in place without movement, even on hitting the ball, but also permit significant extra weight to be placed behind the central, or hand position on the grip without adding additional length to the golf club.

Numerous other advantages and features of the present invention will become readily apparent from the following detailed description of the invention from the accompanying drawing in which each and every detail shown is fully and completely disclosed as a part of this specification in which like numerals refer to like parts.

DETAILED DESCRIPTION OF A PREFERRED EMBODIMENT

Figure 1:
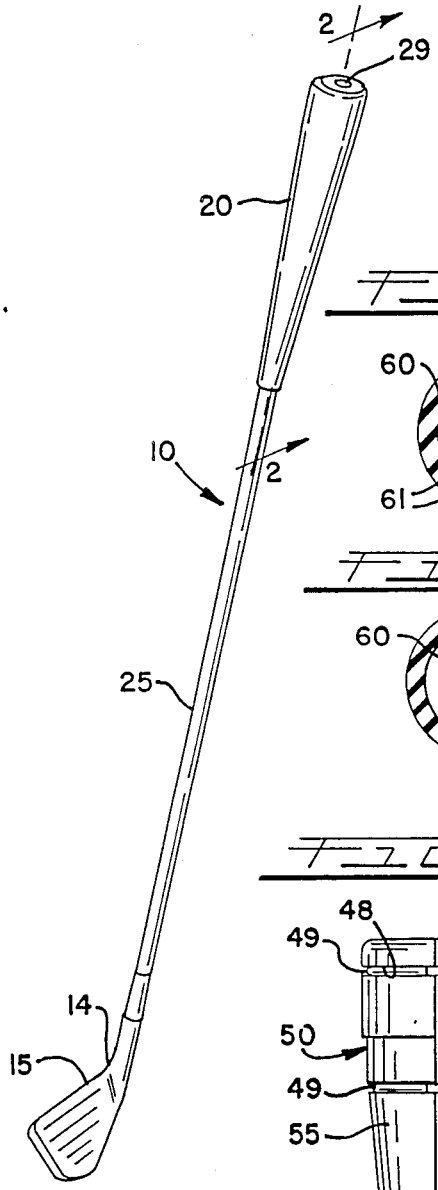
FIG. 1 is a perspective view of a golf club incorporating the grip of the subject invention.

Referring now to FIG. 1, there is shown a golf club 10 having a head portion 15, a shaft portion 25, and a grip portion 20. The grip 20 is generally formed of rubber, plastic or other resilient material for increasing the gripping capabilities of the golfer when swinging the club. The shaft 25 is generally formed of stainless steel, though graphite and fiberglass shafts have been used to decrease the shaft weight and increase flexibility for a longer drive of the ball.

The head 15 of the club is used for engaging and striking a golf ball. The head of the club extends from a toe at the front to a heel at the back. The head typically includes a neck or socket 14 that is in line with the heel. The club also includes a shaft 25 that is secured to the neck of the head. One end of the shaft is secured to the head, and the other end terminates at an outer or distal end. The shaft is generally straight and hollow, although it may be tapered, and defines a passageway or opening 26, which also may be tapered.

Figure 2:
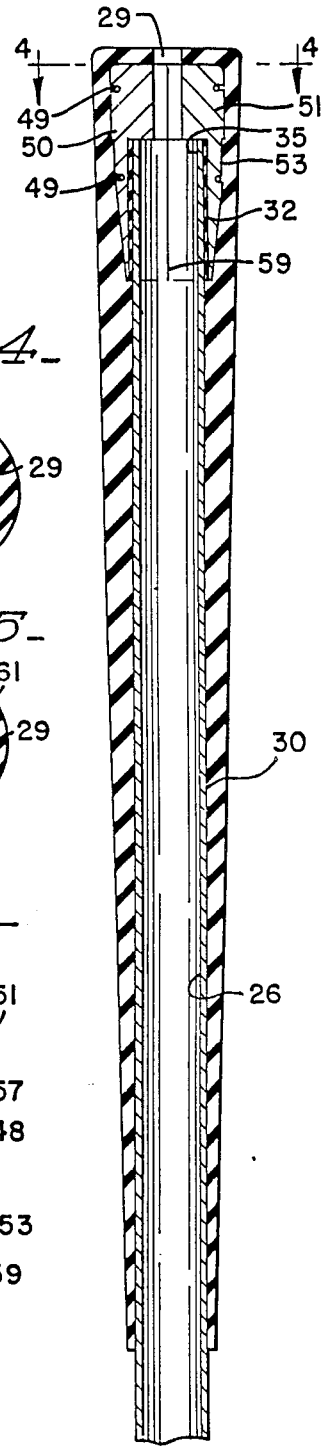
FIG. 2 is a cross section of a portion of the golf club of FIG. 1 taken along the lines 2—2 showing a grip of the subject invention.

The golf club also includes a relatively lightweight grip portion 20 that covers the shaft and permits easier retention by the hands when held by a player. The grip portion encloses the opening 35 defined by the shaft at its outer end with a small opening 29 to facilitate assembly as will be described (FIG. 2). The grip portion includes an annular gripping area 30 that covers the distal end of the shaft, extending from the outer end of the shaft towards the head, typically extending for about one-third of the length of the shaft.

The golf club has a certain center of gravity, or fulcrum point, when positioned generally horizontally. The fulcrum point is easily located by balancing the golf club on a narrow object, such as one's finger. Since most of the weight in a golf club is in the head 15, the fulcrum point is generally located on the shaft 25 at a position closer to the head 12 than the outer end of the shaft. By the subject invention the balance of the club is brought closer to a more even distribution of weight of the club as a whole, by moving the fulcrum point rearwardly.

Figure 3:
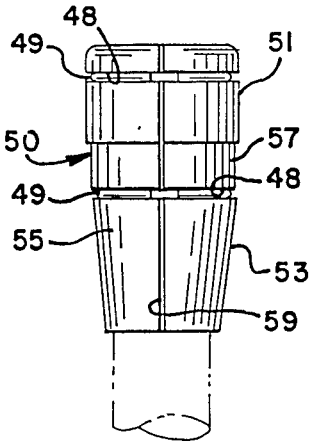
FIG. 3 is a side plan view of one embodiment of the weight portion of the grip of the subject invention.

This more even balance is accomplished through the use of a weight assembly 50 (FIGS. 2, 3), which forms an integral part of the grip portion 20, being encased in the grip material at the furthest point on the shaft opposite the head. The weight assembly in the multi-portion embodiment comprises two or more longitudinal partitions, such as 55 and 57, which when in place on the distal portion of the shaft, are evenly spaced from one another. The weight assembly 50 is formed of a heavy material, preferably metal, such as steel, and may be one piece, or it may be formed of two or more longitudinal portions 55 and 57. Weight assembly 50 has a central upper portion 51 which, when assembled on the shaft, has a mass equally distributed about central opening 29. A flange 53 depends from the outer periphery of each upper portion 51. The weight assembly 50 is of a size in both outside diameter and length so as to permit use of a standard regulation size grip for assembly as all other golf grips, as will be described. The weight of the assembly may be between 50 and 150 grams, though the optimum weight lies between 75 and 100 grams. The grip, including the weight assembly, is formed in a complete one piece unitary construction and requires no additional parts in assembly on the golf club.

Figure 4:
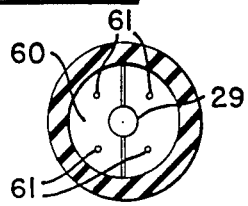
FIG. 4 is a cross section taken along the lines 4—4 of FIG. 2 showing the upper surface of the weight assembly of FIG. 2.

As stated, when a multi-portion weight assembly is used, the longitudinal portions 55 and 57 are located on the shaft 25 in spaced relationship to one another. Within spacing 59 is grip material, such as the rubber or synthetic plastic referred to above. By forming the weight assembly into two or more separate longitudinal portions, the weight may be easily assembled on the die, where it is held in place prior to molding by retainer rings 49 in grooves 48 with the spacing present. For additional assurances that the grip weight will not move during use, a plurality of pins 61 may be driven into the upper face 60 of the weight assembly, leaving only the pin head exposed (FIG. 4). When the grip is molded (preferably by injection molding), the rubber or synthetic plastic material used in molding fills in the spacing 59 between the longitudinal portions 55 and 57, covers the exposed pin heads 61, and fills in the spacing between the flanges 53 and shaft 25 to form an inner peripheral element 32 therebetween, creating a cushion as well as a means for immobilizing the entire weight assembly.

Since the counter balance weight is contained completely within a regulation grip with no change in size, there is no discomfort to a player's hands nor can the grip be an impediment to the player's game. Therefore all the instruction and habits that have been acquired by the player as to the proper hand grip and fundamentals of the game are not disturbed.

The location of the weight as taught herein, i.e. as far back from the head as possible, allows the least addition of weight to the club to achieve the maximum possible effect.

When a ball is struck with the club having the grip of the subject invention, it is imperative that the weight does not move or vibrate in any manner, since this will create a noise or sensation in the club that can distract a player. As stated, to maintain immobility of the weight an inside peripheral element 32 is located between the shaft and the weight in a close fitting relationship.

The inside peripheral element comprises a thin section of resilient material which prevents metal to metal contact and the associated noise and/or vibrations which may distract a golfer. The inside peripheral element 32 properly positions the weight assembly in a precise concentric position on the shaft 25 as well as longitudinally during molding. In addition, this same inside peripheral element permits proper assembly when the grip is glued to the shaft, while forming the weight assembly of two or more longitudinal portions facilitates easy molding, all as described above.

In preparing the grip of the subject invention, the inside diameter of the depending flange must allow for placement of the inside peripheral element therein. This segment of the grip, generally of molded rubber although other resilient materials may be used, must be of a size that will allow a sufficient gap for an adhesive means, such as double faced tape 27, generally 0.005" thick, to be wrapped around the golf club shaft 25, to accommodate normal golf club manufacturing assembly practices. Thus there should be a 0.010" difference between the inside peripheral element diameter and the shaft diameter at the distal end of the club 10. Further, a difference of approximately 0.010" should in a preferred embodiment be between each longitudinal weight assembly to facilitate removal of the molded grip assembly from the die, as well as assembly on the club shaft. When solvent is applied to the exterior face of the tape 27 and the grip is stretched by virtue of the resilient material filled spacing 59 over into position on the shaft, the precise tolerances of the inside peripheral element of the grip results in a close fitting relationship which ultimately, upon evaporation of the solvent, yields a completely immobile, solid grip assembly. Opening 29 permits air to be exhausted on pulling the grip onto the shaft.

Figure 5:
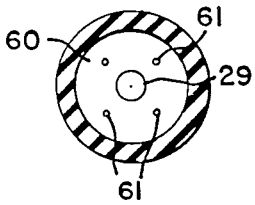
FIG. 5 is a cross section similar to FIG. 4 showing a weight assembly formed of only one piece.

Should the weight assembly be formed in a one piece unit, i.e., without the spacing 59 as shown in FIG. 5, it is imperative that precise tolerances be observed as the inside peripheral element 32, though it must be resilient, cannot expand in diameter during assembly when being forced onto the shaft end; the inside peripheral element 32 is located within and adjacent to the depending flange 53 of the weight's central portion 51 and thus is completely contained and surrounded by the metal flange. As such, substantially no circumferential expansion of the inside peripheral element can occur.

With the Weighted Golf Grip as set forth above an effective counterbalance is provided for the improvement of a golfer's swing, affording him a greater control over the club than previously possible. Such control is achieved by moving the fulcrum point of the club closer to the hand grip. As discussed, this is done by placing the weight behind the hands so that a minimal weight can achieve a maximum movement in the fulcrum point. Further, the subject golf grip may be manufactured and assembled by standard methods. Because the weight is integrally molded within the grip, and the exterior grip dimensions remain within standard grip size tolerance, the grip can be used in tournament play. Because the weight is secured on the outside of the shaft, yet cushioned by the interior resilient element no noise or vibration will distract a golfer on hitting the ball. The end result creates a swing which is consistent and has a tempo best suited for a proper golf swing.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A golf club comprising: a shaft, a club head on one side of said shaft and a grip portion on the distal end of said club opposite said club head;

said shaft having a certain distribution of weight;

said grip portion including a weight assembly on said distal end of said shaft;

said weight assembly comprising at least two longitudinal portions located about said distal golf shaft end in spaced relationship, each longitudinal upper portion having a portion positioned entirely behind said shaft, the combined mass of said longitudinal portions being disposed equally about said shaft end, said longitudinal portions being spaced from one another, thereby creating a gap, said gap being filled with resilient material to permit limited expansion during assembly;

said upper portions each having a flange depending therefrom, said flanges surrounding said shaft at said distal end;

said weight assembly being encompassed by a resilient grip material, and adhesively secured to said shaft, thereby maintaining the relative immobility of said weight assembly and preventing movement of said weight relative to said shaft;

whereby said weight displaces the weight distribution on said shaft to a point closer said distal end.

2. The golf club of claim 1 wherein an adhesive means is disposed directly adjacent said shaft along the entire grip portion.

3. The golf club of claim 1 wherein said flanges and said resilient material provides a tight fit on said shaft.

4. The golf club of claim 1 wherein said weight assembly has a mass distributed equally about a central axis, said axis corresponding to the central axis of said shaft.

5. The golf club of claim 1 wherein said weight assembly has a plurality of pin heads extending from an upper face of said upper portion, said pin heads being covered by said resilient grip material thereby impeding movement of said weight assembly on said golf club.

6. A golf club comprising: a shaft, a club head on one side of said shaft and a grip portion on the distal end of said club opposite said club head;

said shaft having a fulcrum point intermediate said club head and said grip;

said grip portion including a weight assembly on said distal end of said shaft;

said weight assembly having a central portion positioned entirely behind said shaft;

said central portion having an opening therethrough and an outer periphery, the mass of said central portion being disposed equally about said opening, said central portion having a flange depending from said outer periphery of said central portion and surrounding said shaft at said distal end;

a plurality of pins extending from an upper face of said central portion;

said weight assembly being encompassed by a resilient grip material, including said pins, thereby maintaining the relative immobility of said weight and preventing lateral movement of said weight relative to said shaft;

whereby said weight displaces said fulcrum point on said shaft to a point closer said distal end.

* * * * *